US007141732B2

(12) United States Patent
Tsuboi

(10) Patent No.: US 7,141,732 B2
(45) Date of Patent: Nov. 28, 2006

(54) STORING APPARATUS AND STORING METHOD FOR MUSIC DATA

(75) Inventor: Shoichi Tsuboi, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 415 days.

(21) Appl. No.: 10/725,096

(22) Filed: Dec. 1, 2003

(65) Prior Publication Data

US 2004/0139844 A1 Jul. 22, 2004

(30) Foreign Application Priority Data

Dec. 6, 2002 (JP) ..... 2002-354760

(51) Int. Cl.
*G10H 1/00* (2006.01)

(52) U.S. Cl. ..... 84/601; 84/602; 700/94

(58) Field of Classification Search ..... 84/600–608; 707/3; 700/3, 94
See application file for complete search history.

(56) References Cited

U.S. PATENT DOCUMENTS 6,304,523 B1 * 10/2001 Jones et al. ..... 707/104.1
6,423,892 B1 7/2002 Ramaswamy
2003/0158737 A1 * 8/2003 Csicsatka ..... 704/273

* cited by examiner

*Primary Examiner*—Marlon T. Fletcher
*Assistant Examiner*—David S. Warren
(74) *Attorney, Agent, or Firm*—Brinks Hofer Gilson & Lione

(57) ABSTRACT

Music information about songs recorded on multiple CD's is stored in a first storing means 21, and when music data of the individual songs of the CD 12 is stored on the hard disk drive 22, music information about the individual songs is read from the first storing means 21, is added to the music data, and the information and the data are stored. If the music information is not stored in the first storing means, the music data is stored without adding the music information, and contemporaneously, CD identification information and stored locations of the music data of the individual songs on the hard disk drive 22 are stored in second storing means 23. When the version of the first storing means 21 is updated, if music information about a CD indicated by CD identification information stored in the second storing means 23 is stored in the updated first storing means 21, the music information about a song read from the first storing means is added to music data at a stored location read from the second storing means.

20 Claims, 11 Drawing Sheets

STORING APPARATUS AND STORING METHOD FOR MUSIC DATA

BACKGROUND OF THE INVENTION

1. Field of the Invention

The present invention relates to a storing apparatus and method for music data, and specifically relates to a storing apparatus and method that adds music information about a song to music data of the song read from a storage medium such as a compact disc (CD), and then, stores the music information and the music data in a storing unit.

2. Description of the Prior Art

A music data storing apparatus that reads music data from a CD and records the data into a storing unit such as a hard disk drive (HDD) has been put into a practical use. Such an apparatus can read and reproduce the music data from the hard disk drive (HDD) after storing the music data.

In this music data storing apparatus, music information about songs recorded on multiple CD's is stored into first storing means (a local data base CDDB) 2 for the respective CD's in advance as shown in FIG. 11. For example, a combination of lengths of the individual songs and gap lengths contained in TOC information of a CD is used as CD identification information, and music information including an album title, an artist name, titles of the individual songs is stored in the CDDB2 in correspondence to the storage medium identification information. Note that the CD identification information is constituted as a first song length—a gap length—a second song length—a gap length— . . . —a last song length.

When music data from a predetermined CD 1 is stored on a hard disk drive (HDD) 3, a music data management control unit 4 refers to TOC information (CD identification information) of the CD 1, and determines whether music information is stored in the local CDDB 2, and the music data management control unit 4 adds music information 1 on a first song to music data 1 of the first song read from the CD 1, and stores them on the hard disk drive 3 if the music information about CD 1 is stored in the local CDDB 2. Subsequently, in the same manner, music information j (j=1, 2, 3, . . . ) is added to music data j read from the CD 1, and they are stored on the hard disk drive 3, and similarly further, music data read from another CD added with music information is stored on the hard disk drive 3. Then, as for reproduction, when reproduction from the HDD is requested from an operation unit 5 to the music data management control unit 4, the music data management control unit 4 sequentially reads music data from the hard disk drive 3, and supplies an audio circuit 6 with the music data, thereby outputting sound from a speaker 7. Additionally, reproduction at random is carried out by receiving a music information list by the music data management control unit 4, showing the list on a display unit of the operation unit 5, and allowing selection of desired music. In addition, when several sets of a sequence of desired songs to be reproduced are determined in advance as folders, it is possible to sequentially reproduce songs in a set by selecting the set.

Note that the above description is given of a case where the music information about the CD 1 is stored in the local CDDB 2. However, the music information stored in the CDDB 2 obsoletes and becomes old, the CDDB 2 does not contain music information about the latest CD's, and the music information about CD 1 may not be stored in the local CDDB 2. In this case, though music data can be stored in a music data entry 3*b* on the hard disk drive 3, correct music information cannot stored in a music information entry 3*a*, and substituting music information such as information entered from a key unit of the operation unit 5 and a recorded date are stored in the music information entry 3*a*.

SUMMARY OF THE PRESENTLY PREFERRED EMBODIMENTS

In the prior art, a problem emerges when stored contents on the local CDDB 2 are updated to the latest version. Namely, when the stored contents on the local CDDB 2 are updated to the latest version, it is ideal that substituting music information stored in the music information entry 3*a* on the hard disk drive 3 could be rewritten with correct music information based on the latest information. However, in prior art, it is impossible to rewrite the substituting music information with the correct music information.

Namely, in the prior art, when the same CD is used to record the music data on the hard disk drive 3, the music data is stored on the hard disk drive 3 in addition to the old music data which remains. Consequently, the same song is redundantly stored on the hard disk drive 3, and the storage area is wastefully used.

Further, even if the substituting music information could be rewritten with correct music information, because a CD may often be rented from a rental shop or borrowed from a friend, it would be necessary to rent or borrow the CD again.

In view of the foregoing, an object of the present invention is to enable to automatically rewrite substituting music information recorded in a storing unit such as a hard disk drive with correct music information when the version of the local CDDB is updated.

Additional object of the present invention is to enable automatic rewriting of substituting music information recorded on a storing unit such as a hard disk drive with correct music information from an external apparatus through the Internet even when the version of the local CDDB is not updated.

Still another object of the present invention is to enable rewriting of substituting music information with correct music information even if the music information is not read from a CD again.

A first and second embodiment of the present invention both relate to a storing apparatus and a storing method that add music information about a song to music data of the song read from a storage medium such as a CD, and store the music information and the music data into a storing unit such as a hard disk drive.

In the music data storing apparatus according to the first embodiment, (1) music information about individual songs recorded on multiple storage media is stored in advance in a first storing means. (2) When music data from a predetermined storage medium is to be stored in the storing unit (e.g., a hard disk drive), it is determined whether music information about the storage medium has been stored in the first storing means. (3) If the music information has not been stored in the first storing means, the music data of the individual songs is stored on the hard disk drive without adding the music information or with adding substituting music information, and contemporaneously, identification information about the storage medium and stored locations of the music data for the individual songs on the hard disk drive is stored in second storing means. (4) When the version of the music information stored in the first storing means is updated, it is determined whether music information about a storage medium indicated by identification information stored in the second storing means is stored in the updated first storing means. (5) If the music information is stored, the music information about a song read from the first storing means is stored on the hard disk drive such that the music information is added to music data at a stored location read from the second storing means. In addition, in act (2) described above, when the music data from the predetermined storage medium will be stored on the hard disk drive, if the music information about the storage medium is stored in the first storing means, the music information is added to the music data of the song read from the storage medium, and both are stored on the hard disk drive.

With the constitution described above, it is possible to automatically rewrite substituting music information recorded in the storing unit (such as a hard disk drive) with correct music information when the version of the local CDDB is updated. In addition, it is possible to rewrite the substituting music information with the correct music information without reading out the music information from a CD again.

In the music data storing apparatus according to a second aspect of the preferred embodiments, (1) music information about individual songs recorded on storage media is stored in first storing means. (2) When music data from a predetermined storage medium is to be stored in the storing unit (hard disk drive), it is determined whether music information about the storage medium has been stored in the first storing means. (3) If the music information has not been stored in the first storing means, it is determined whether music information about the individual songs recorded on the storage medium can be obtained from an external apparatus through the Internet. (4) If the music information about the predetermined storage medium is not stored in the first storing means, and contemporaneously, cannot be obtained from the external apparatus, the music data of the individual songs is stored on the hard disk drive without adding the music information or with adding substituting music information, and contemporaneously, identification information about the storage medium and stored locations of the music data for the individual songs on the hard disk drive are stored in second storing means. (5) It is determined properly (such as on system startup) whether music information about a storage medium indicated by identification information stored in the second storing means can be obtained from the external apparatus through the Internet. (6) If the music information can be obtained, the obtained music information about a song is stored on the hard disk drive such that the music information is added to music data at a stored location read from the second storing means. In addition, in act (2) described above, when the music information about the predetermined storage medium will be stored on the hard disk drive, if the music information about the storage medium is stored in the first storing means, or can be obtained from the external apparatus through the Internet, the music information is added to music data of the song read from the storage medium, and both are stored on the hard disk drive.

As described above, with the second aspect of the preferred embodiments, as long as the version of the external apparatus is updated, it is possible to automatically and immediately rewrite the substituting music information recorded in the storing unit such as a hard disk drive with correct music information without updating the version of the local CDDB. In addition, it is possible to rewrite the substituting music information with correct music information even if the music information is not read out from a CD again.

DETAILED DESCRIPTION OF THE PREFERRED EMBODIMENTS (A) First Embodiment

Figure 1:
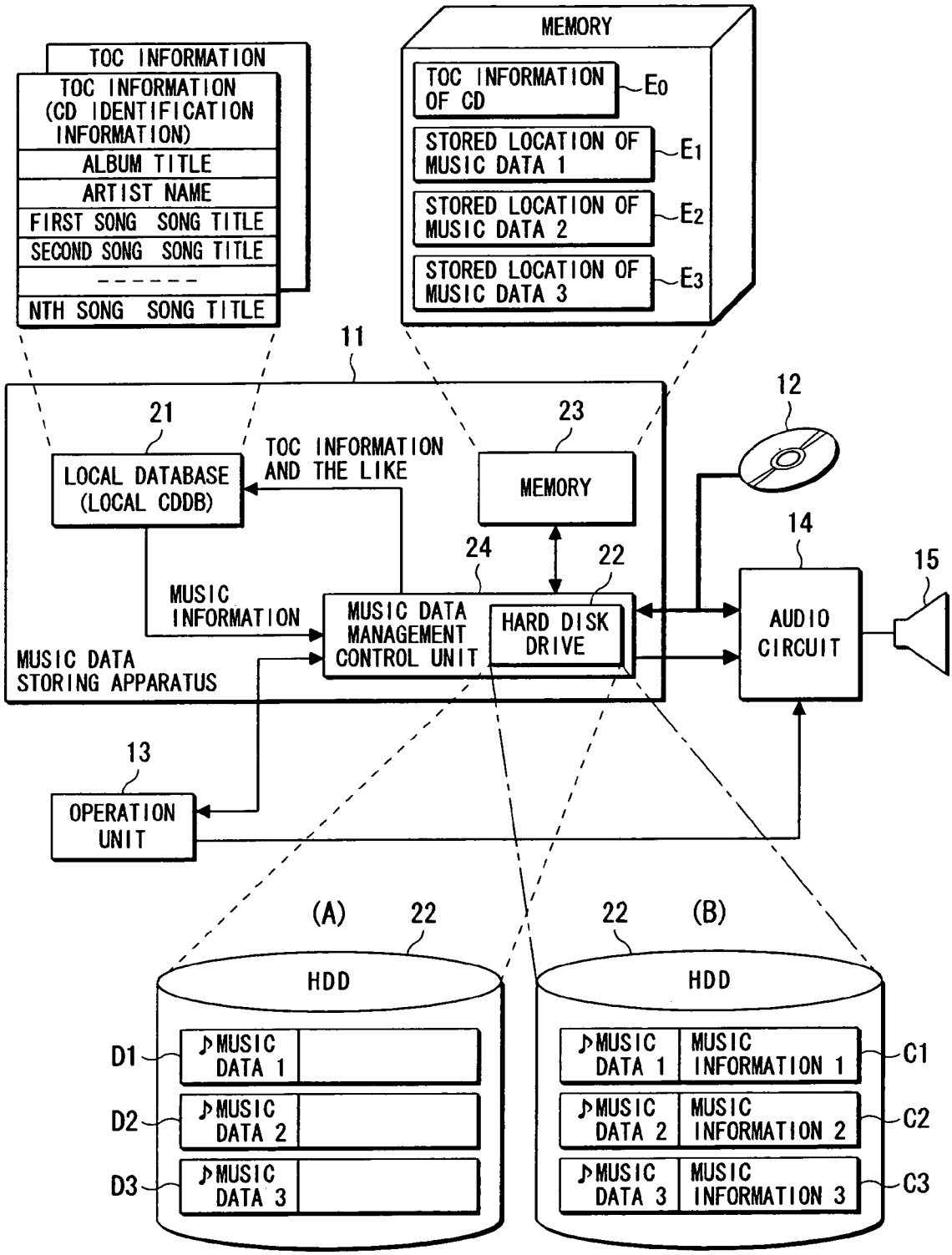
FIG. 1 is a schematic constitution diagram of an audio apparatus including a music data storing apparatus according to a first embodiment.

FIG. 1 is a schematic constitution diagram of an audio apparatus including a music data storing apparatus according to a first embodiment of the present invention. The music data storing apparatus 11 is provided with a local data base (local CDDB) 21 that stores music information about songs recorded on a large number of CD's for the respective CD's in advance, a hard disk drive 22 for storing music data of CD's, a memory 23 for storing TOC information of CD's and stored locations of the music data on the hard disk drive for the individual songs, and a music data management control unit 24.

The local CDDB 21 uses a combination of lengths of the individual songs and gap lengths contained in TOC information of a CD as CD identification information, and stores music information including a CD album title, an artist name, titles of the individual songs in correspondence to the CD identification information. Note that the CD identification information is constituted as a first song length—a gap length—a second song length—a gap length— . . . —a last song length.

(a) Case where music information about CD's are stored in a local CDDB:

To store music data on a predetermined CD 12 in a hard disk drive 22, the music data management control unit 24 refers to TOC information (CD identification information) of the CD 12, and determines whether music information about the CD 12 is stored in the local CDDB 21, and the music data management control unit 24 adds music information 1 about a first song to music data 1 of the first song read from the CD 12, and stores them on the hard disk drive 22 if the music information about CD 12 is stored in the local CDDB 21 (See C1 of(B)).

Subsequently, in the same manner, music information i (i=1, 2, 3, . . . ) is added to music data i read from the CD 12, and they are stored on the hard disk drive 22, and similarly further, music data read from another CD added with music information is stored on the hard disk drive 22 (See C1, C2, C3, . . . of (B)).

Then, for the reproduction, when the reproduction from the HDD is requested from an operation unit 13 to the music data management control unit 24, the music data management control unit 24 sequentially reads music data from the hard disk drive 22, and supplies an audio circuit 14 with the music data, thereby outputting sound from a speaker 15. Additionally, reproduction at random is carried out by receiving a music information list by the music data management control unit 24, showing the list on a display unit of the operation unit 13, and allowing selection of desired music. In addition, when several sets of a sequence of desired songs to be reproduced are determined in advance as folders, it is possible to sequentially reproduce songs in a set by selecting the set.

(b) Case where music information about CD's are not stored in a local CDDB:

The above description is given of a case where the music information about the CD 12 is stored in the local CDDB 21. However, the music information stored in CDDB 21 obsoletes and becomes old. The CDDB 21 does not contain music information about the latest CD's, and the music information about CD 12 may not be stored in the local CDDB 21. In this case, the music data management control unit 24 stores music data D1, D2, D3, . . . of the individual songs of the CD 12 without adding music information or with adding substituting music information on the hard disk drive 22 (see D1, D2, and D3 in (A)), and simultaneously, stores CD identification information E0 and stored locations E1, E2, E3, . . . of the music data of the individual songs on the hard disk drive 22 into the memory 23. Subsequently, a process similar to the above description is carried out when music information about a CD is not stored in the local CDDB.

Figure 2:
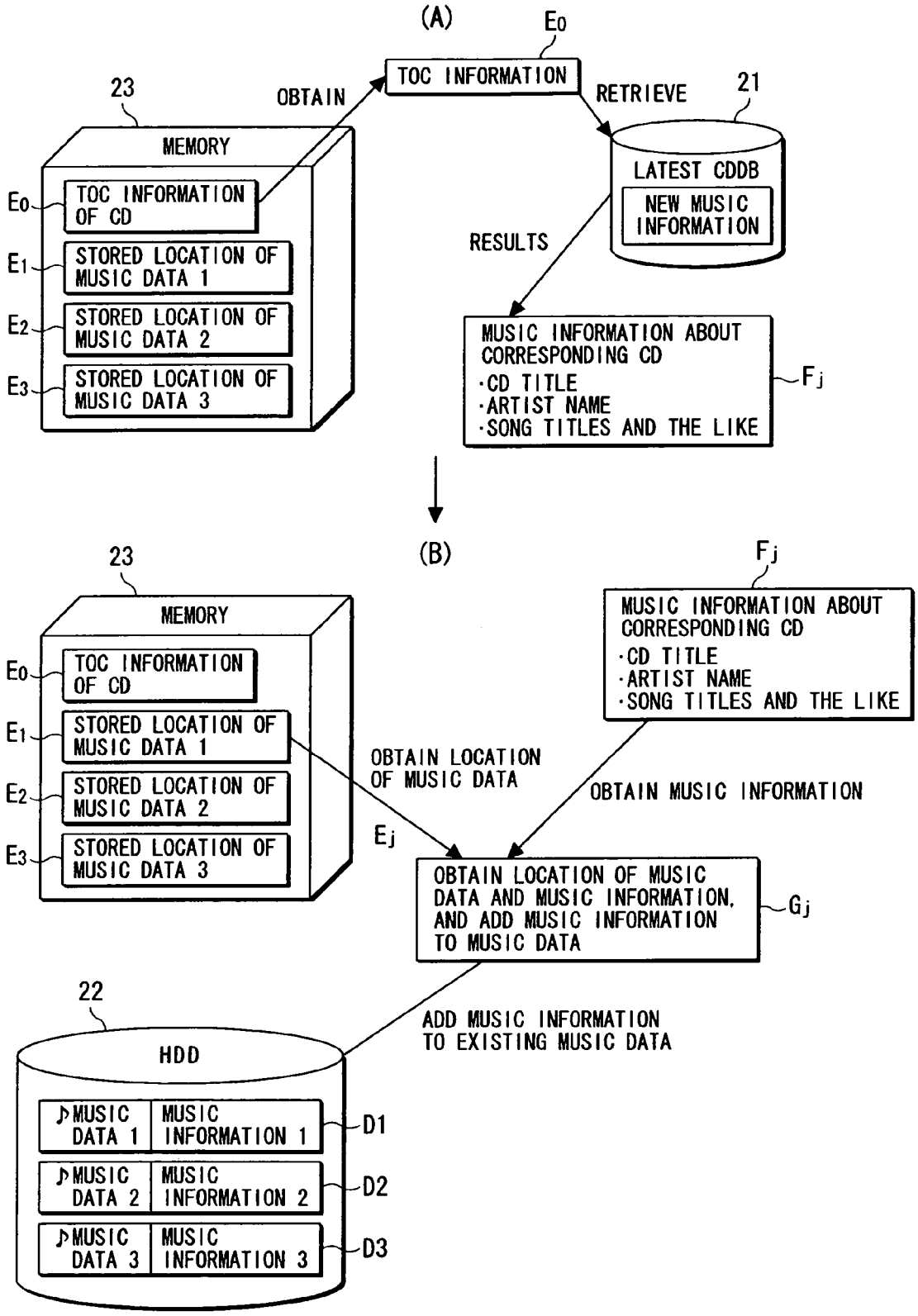
FIG. 2 describes the operation of a preferred embodiment of the present invention.

In this state, when the version of the music information stored in the local CDDB 21 is updated as shown in FIG. 2(A), the music data management control unit 24 carries out the following process.

The music data management control unit 24 determines whether music information about the CD indicated by the CD identification information E0 stored in the memory 23 is stored in the local CDDB 21 whose version is updated. If the music information is stored in the CDDB 21, the music data management control unit 24 reads music information Fj about a jth song (j=1, 2, 3, . . . ) from the local CDDB 21, then, reads a stored location Ej of the jth song from the memory 23 as shown in FIG. 2(B), combines the music information Fj about the jth song and the stored location Ej of the jth song, and stores combined data Gi on the hard disk drive 22, thereby adding the correct music information Fj to the music data Dj.

Figure 3:
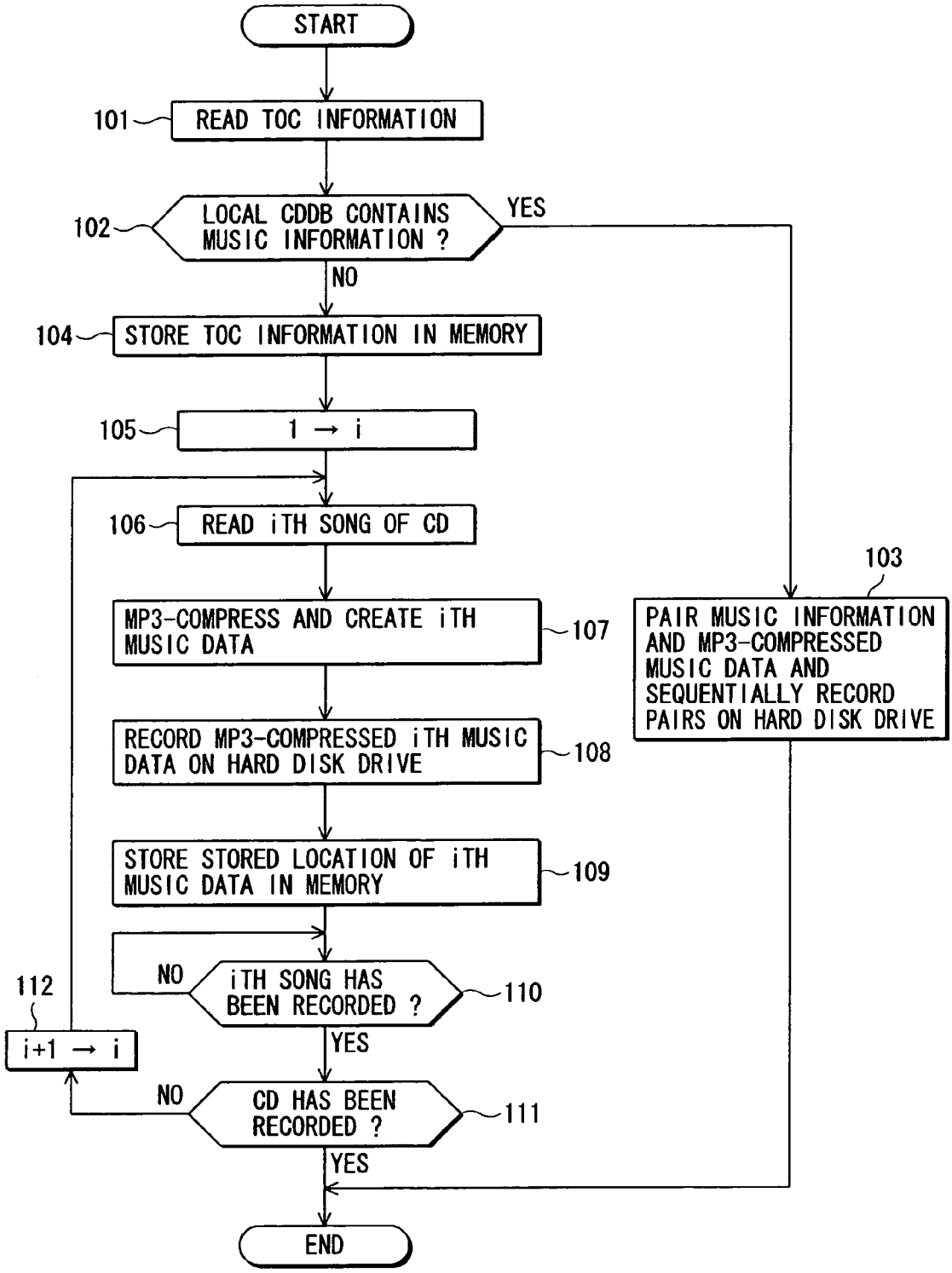
FIG. 3 shows a process flow according to the first embodiment for reading music data from a CD, and storing the data on a hard disk drive.

FIG. 3 shows a process flow according to the first embodiment for reading music data from a CD, and storing the data on the hard disk drive.

The music data management control unit 24 reads the TOC information from the CD 12 (act 101), checks whether the TOC information is stored in the local CDDB 21 (act 102), reads out music information about the individual songs from the local CDDB 21 if the TOC information is stored in the local CDDB 21, pairs the music information and music data which are encoded (MP3-compressed) individual songs, stores the pairs on the hard disk drive 22 (act 103), and terminates the process.

On the other hand, if the TOC information is not stored in the local CDDB 21 in the act 102, the music data management control unit 24 stores the TOC information into the memory 23 (act 104). Then, as for i=1 (act 105), the music data management control unit 24 reads an ith song of the CD 12 (act 106), MP3-compresses music data of the ith song into an ith encoded music data (act 107), and records the MP3-compressed ith encoded music data on the hard disk drive 22 (act 108).

Then, the music data management control unit 24 stores a stored location of the encoded music data of the ith song, namely, the stored address (stored location) on the hard disk drive, into the memory 23 (act 109), and monitors if the recording of the ith song has completed (act 110).

If the recording of the ith song completes, the music data management control unit 24 checks whether recording of all the songs on the CD has completed (act 111). If the recording has not completed yet, i is set as i+1→i (act 112), the process starting from the step 106 is repeated subsequently, and the recording to the hard disk drive completes when all the songs have been recorded in the step 111.

Figure 4:
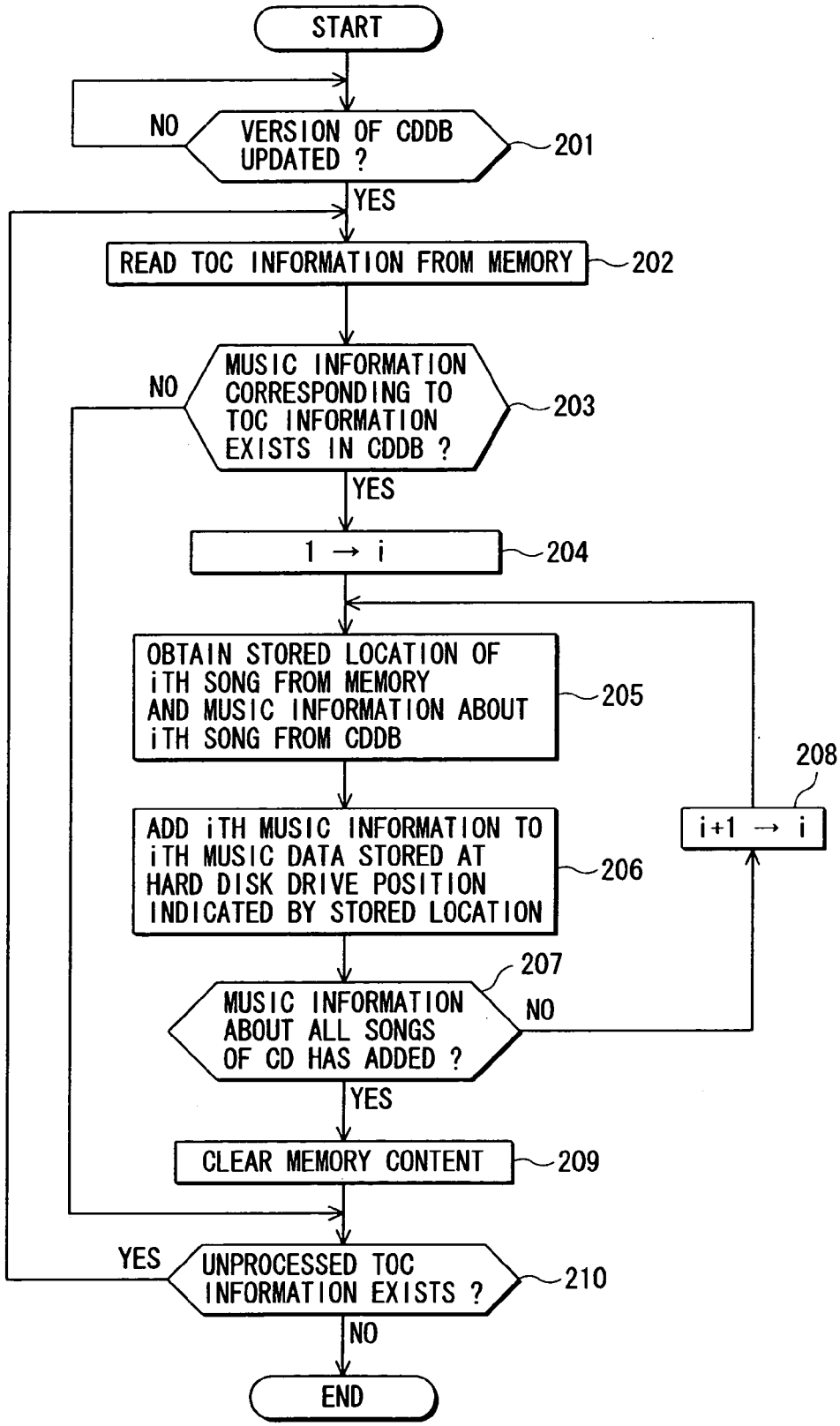
FIG. 4 shows a process flow according to the first embodiment that writes correct music information on the hard disk drive when the version of a local CDDB is updated.

FIG. 4 shows a process flow according to the first embodiment which writes correct music information on the hard disk drive when the version of the local CDDB is updated.

The music data management control unit 24 monitors whether the version of the local CDDB is updated (act 201), reads TOC information stored in the memory 23 if the version is updated (act 202), and checks whether music information about a CD identified by the TOC information exists in the new local CDDB 21 (act 203). If the music information does not exist, the music data management control unit 24 checks whether unprocessed TOC information exists in the memory 23 (act 210), and terminates the process if the information does not exists, or returns to the act 202 to repeat the following process if the information exists.

On the other hand, if the music information about the CD identified by the TOC information exists in the new local CDDB 21 in the act 203, the music data management control unit 24 sets i as i=1 (act 204), reads the stored location of the ith song from the memory 23, and simultaneously, obtains music information about the ith song from the new local CDDB 21 (act 205). Then, the music data management control unit 24 causes the ith music information is added to the ith music data stored at a hard disk drive location indicated by the stored location (act 206). Then, the music data management control unit 24 checks whether addition or rewrite of music information about all the songs of the CD has completed (act 207), and if it has not completed, i is set as i+1→i (act 208), and the music data management control unit 24 repeats the process starting from the act 205.

If the addition or rewrite of the music information about all the songs of the CD has completed, the music data management control unit 24 clears stored contents corresponding to the CD in the memory 23 (act 209), then, checks whether unprocessed TOC information exists in the memory 23 (act 210), and terminates the process if the unprocessed information does not exist, or returns to the act 202 and repeats the following process if the unprocessed information exists.

Figure 5:
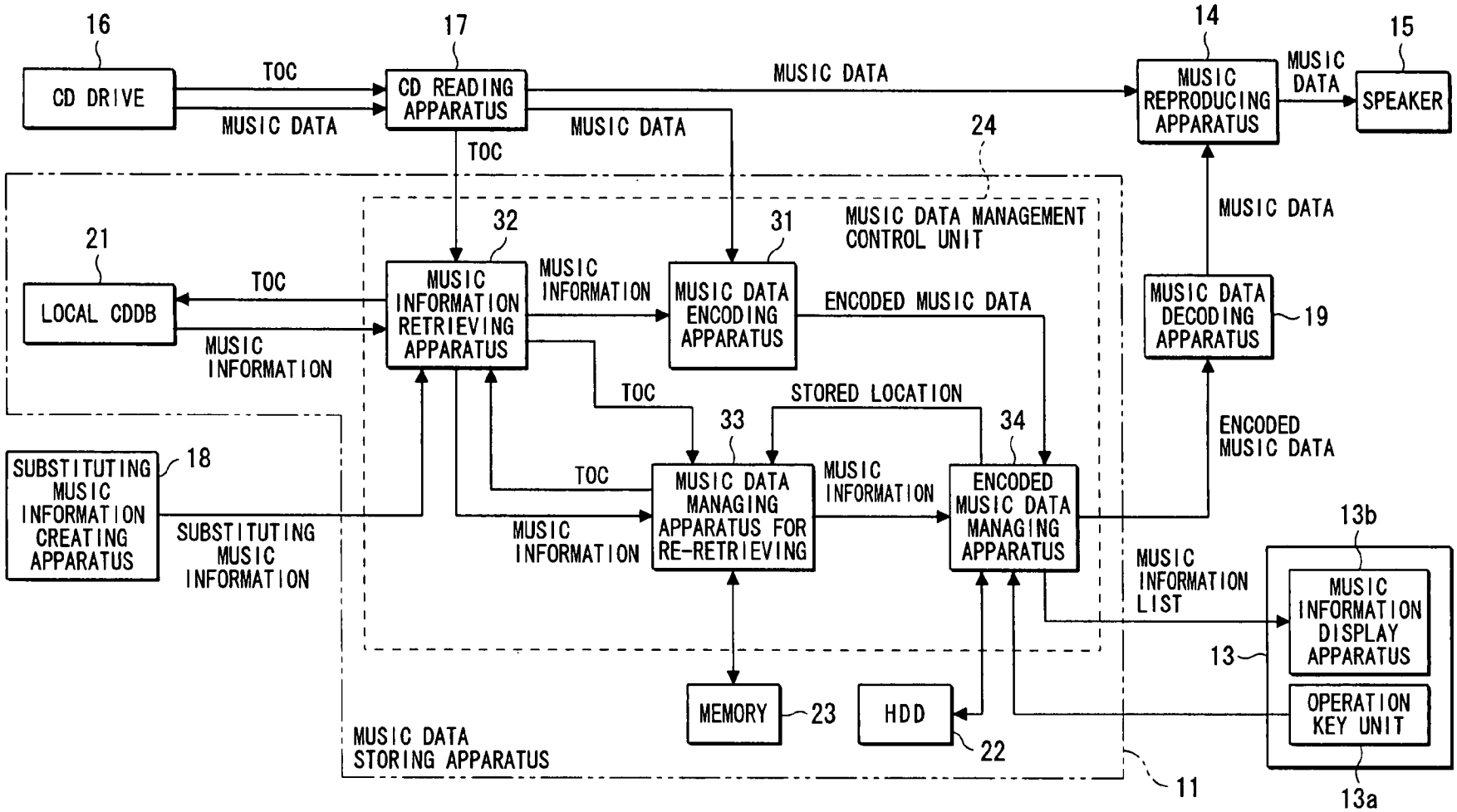
FIG. 5 is a detailed constitution diagram of an audio circuit provided with the music data storing apparatus according to the first embodiment.

FIG. 5 is a detailed constitution diagram of an audio circuit provided with the music data storing apparatus according to the first embodiment, and the same parts are denoted by the same numerals as in FIG. 1. A CD drive 16 applies spindle rotation control to a CD so as to present a constant linear velocity, and simultaneously, applies focus/tracking control to the CD, and a CD reading apparatus 17 applies digital signal processing to a signal read by optical pickup after applying ETM processing and AGC processing, thereby generating TOC information and music data. The music reproducing apparatus 14 uses the music data to output reproduced sound from the speaker 15 after carrying out DA conversion and other control.

When the CD reading apparatus 17 stores the music data read from the CD on the hard disk drive 22, the CD reading apparatus 17 inputs the TOC information and the music data to the music data management control unit 24. The music data management control unit 24 includes a music data encoding apparatus 31, a music information retrieving apparatus 32, a music data managing apparatus for re-retrieving 33, and an encoded music data managing apparatus 34.

The music data encoding apparatus 31 encodes music data of a song, and (1) adds music information about the song to the encoded music data and inputs them to the encoded music data managing apparatus 34 if the music information is stored in the local CDDB 21. The music data encoding apparatus 31 (2) adds substituting music information created by a user and an input from a substituting music information creating apparatus 18 to the encoded music data, and inputs them to the encoded music data managing apparatus 34 if the music information about the song is not stored in the local CDDB 21. The encoded music data managing apparatus 34 stores the music data with the music information on the hard disk drive 22 for the individual songs of the CD in the case (1) described above, and stores the music data with the substituting music information on the hard disk drive 22, and contemporaneously inputs stored addresses (stored locations) of the music data of the individual songs to the music data managing apparatus for re-retrieving 33 for the individual songs of the CD in the case (2) described above. Note that the substituting music information creating apparatus 18 is not always necessary.

When a CD is recorded, the music data managing apparatus for re-retrieving 33 stores CD identification information (TOC information) about the CD and stored location of the music data of the individual songs on the hard disk drive 22 in the memory 23 if the music information about the CD is not stored in the local CDDB 21. In addition, the music data managing apparatus for re-retrieving 33 inputs the TOC information stored in the memory 23 to the music information retrieving apparatus 32 when the version of the local CDDB 21 is updated. Then, if the music information identified by the TOC information is stored in the updated local CDDB 21, the music data managing apparatus for re-retrieving 33 obtains music information about a song from the local CDDB 21 through the music information retrieving apparatus 32, and contemporaneously, obtains the stored location of the song from the memory 23, pairs the music information and the location, and inputs the pair to the encoded music data managing apparatus 34. The encoded music data managing apparatus 34 rewrites substituting music information added to music data stored at an area indicated by the received stored location with the received music information, and stores them on the hard disk drive. Note that the encoded music data managing apparatus 34 adds the received music information to the music data, and stores them on the hard disk drive if no substituting music information exists.

When a CD is recorded, the music information retrieving apparatus 32 determines whether music information about the CD is stored in the local CDDB 21, obtains the music information about individual songs of the CD, and inputs the information to the music data encoding apparatus 31 if the music information is stored, or properly inputs substituting music information to the music data encoding apparatus 31 if the music information is not stored. As a result, the music data encoding apparatus 31 adds the music information or the substituting music information to the encoded music data, and inputs them to the encoded music data managing apparatus 34.

Additionally, the music information retrieving apparatus 32 determines whether music information about a CD indicated by TOC information input from the music data managing apparatus for re-retrieving 33 is stored in the updated local CDDB 21 when the version of the local CDDB 21 is updated, and obtains music information about the CD from the local CDDB 21, and inputs the music information to the music data managing apparatus for re-retrieving 33 if the music information is stored. As a result, the music data managing apparatus for re-retrieving 33 pairs the input music information about the song and the stored location of the song read from the memory 23, and inputs them to the encoded music data managing apparatus 34. The encoded music data managing apparatus 34 rewrites substituting music information added to music data stored at an area indicated by the received stored location with the received music information, and stores them on the hard disk drive.

To reproduce music information stored on the hard disk drive 22, when reproduction from HDD is requested from a key unit 13*a* of the operation unit 13 to the encoded music data managing apparatus 34, the encoded music data managing apparatus 34 sequentially reads out music data from the hard disk drive 22, and inputs the music data to a music data decoding apparatus 19. The music data decoding apparatus 19 decodes the encoded music data, and inputs the decoded data into the music reproducing apparatus 14, thereby outputting sound from the speaker 15. Also, when reproduction at random is requested from the key unit 13*a* of the operation unit 13, since the encoded music data managing apparatus 34 transmits a music information list stored on the hard disk drive 22, and the list is shown on a music information display apparatus 13*b*, desired music can be selected. In addition, when several sets of a sequence of desired songs to be reproduced are determined in advance as folders, it is possible to sequentially reproduce songs in a set by selecting the set.

With the first embodiment, it is possible to automatically rewrite substituting music information recorded in the storing unit (such as a hard disk drive) with correct music information when the version of the local CDDB is updated. In addition, it is possible to rewrite the substituting music information with correct music information even without reading out the music information from a CD again.

(B) Second Embodiment

Figure 6:
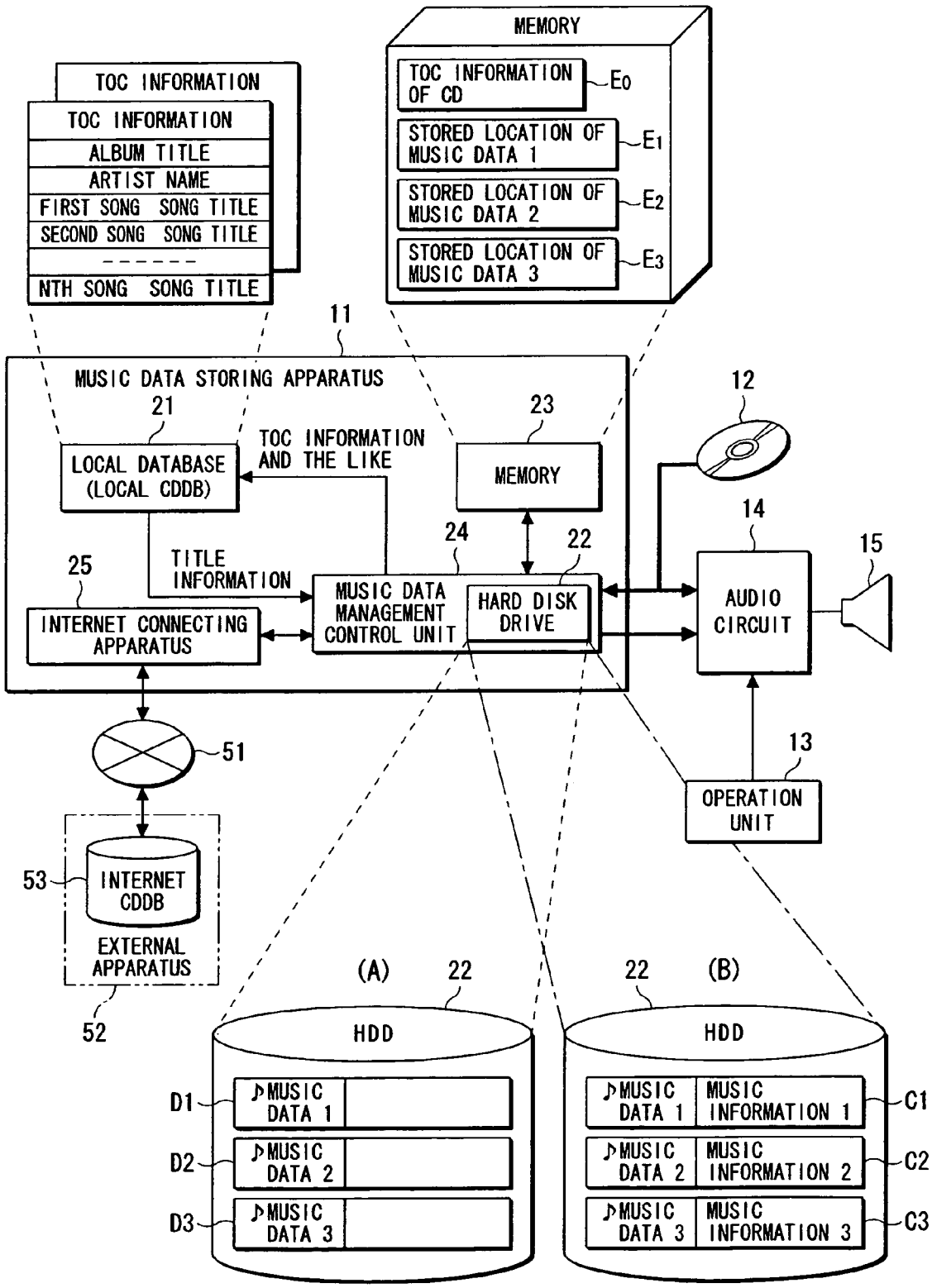
FIG. 6 is a schematic constitution diagram of an audio apparatus including a music data storing apparatus according to a second embodiment.

FIG. 6 is a schematic constitution diagram of an audio apparatus equipped with a music data storing apparatus according to a second embodiment, and the same parts are denoted by the same numerals as in FIG. 1. A different point is that an Internet connecting apparatus 25 is provided in the music data storing apparatus 11, and music information about a CD can be obtained from an Internet CDDB 53 built into an external apparatus 52 through the Internet 51. A service provider stores music information about the latest CD's in the Internet CDDB 53, and provides users with the music information. The music information is stored in the Internet CDDB 53 in a format similar to that of the local CDDB 21.

An update interval of the Internet CDDB 53 is short, and thus, it is highly probable to obtain music information even about the latest CD. Therefore, if music information cannot be obtained for a CD being recorded from the local CDDB 21, obtaining the music information is tried from the Internet CDDB 53.

(a) Case where music information about a CD is stored in the local CDDB or the Internet CDDB:

To store music information on a predetermined CD 12 on the hard disk drive 22, the music data management control unit 24 refers to TOC information (CD identification information) of the CD 12, and determines whether music information about the CD 12 is stored in the local CDDB 21, and the music data management control unit 24 adds music information 1 about a first song to music data 1 of the first song read from the CD 12, and stores them on the hard disk drive 22 if the music information about the CD 12 is stored in the local CDDB 21 (see C1 of (B)). Subsequently, similarly, music information i (i=1, 2, 3, . . . ) is added to music data i read from the CD 12, and is stored on the hard disk drive 22 (see C1, C2, C3, . . . of (B)), and similarly further, music data read from another CD added with music information is stored on the hard disk drive 22.

However if the music information about the CD 12 is not stored in the local CDDB 21, the music data management control unit 24 presents the TOC information of the CD being recorded to the external apparatus 52 through the Internet connecting apparatus 25 and the Internet 51, and requests for the music information. The external apparatus 52 carries out retrieval in the Internet CDDB 53, and transmits the requested music information about the CD corresponding to the TOC information to the music data management control unit 24 through the Internet connecting apparatus 25 if the music information exists. Consequently, the music data management control unit 24 adds music information i (i=1, 2, 3, . . . ) to music data i read from the CD 12, and stores them on the hard disk drive 22 as in the case where the music information exists in the local CDDB 21.

In this state, it is possible to reproduce music stored on the hard disk drive 22 in the same way as in the first embodiment.

(b) Case where music information about a CD is stored neither in the local CDDB nor the Internet CDDB:

The above description is given of a case where the music information about the CD 12 is stored either in the local CDDB 21 or the Internet CDDB 53. However, the music information about the CD 12 may be stored neither in the local CDDB 21 nor the Internet CDDB 53. In this case, the music data management control unit 24 stores only music data D1, D2, D3, . . . of the individual songs of the CD 12 without adding music information (or with adding substituting music information in some cases) on the hard disk drive 22 (see (A)), and simultaneously, stores CD identification information (TOC information) E0 and stored locations E1, E2, E3, . . . of the music data of the individual songs on the hard disk drive 22 into the memory 23. Subsequently, a process similar to the above description is carried out if the music information about the CD is not stored in the local CDDB 21.

In this state, as shown in FIG. 7(A), the music data management control unit 24 determines whether music information about a CD indicated by CD identification information E0 stored in the memory 23 can be obtained from the Internet CDDB 53 each time the system starts, and obtains the music information Fj about the CD from the Internet CDDB 53 if possible.

Figure 7:
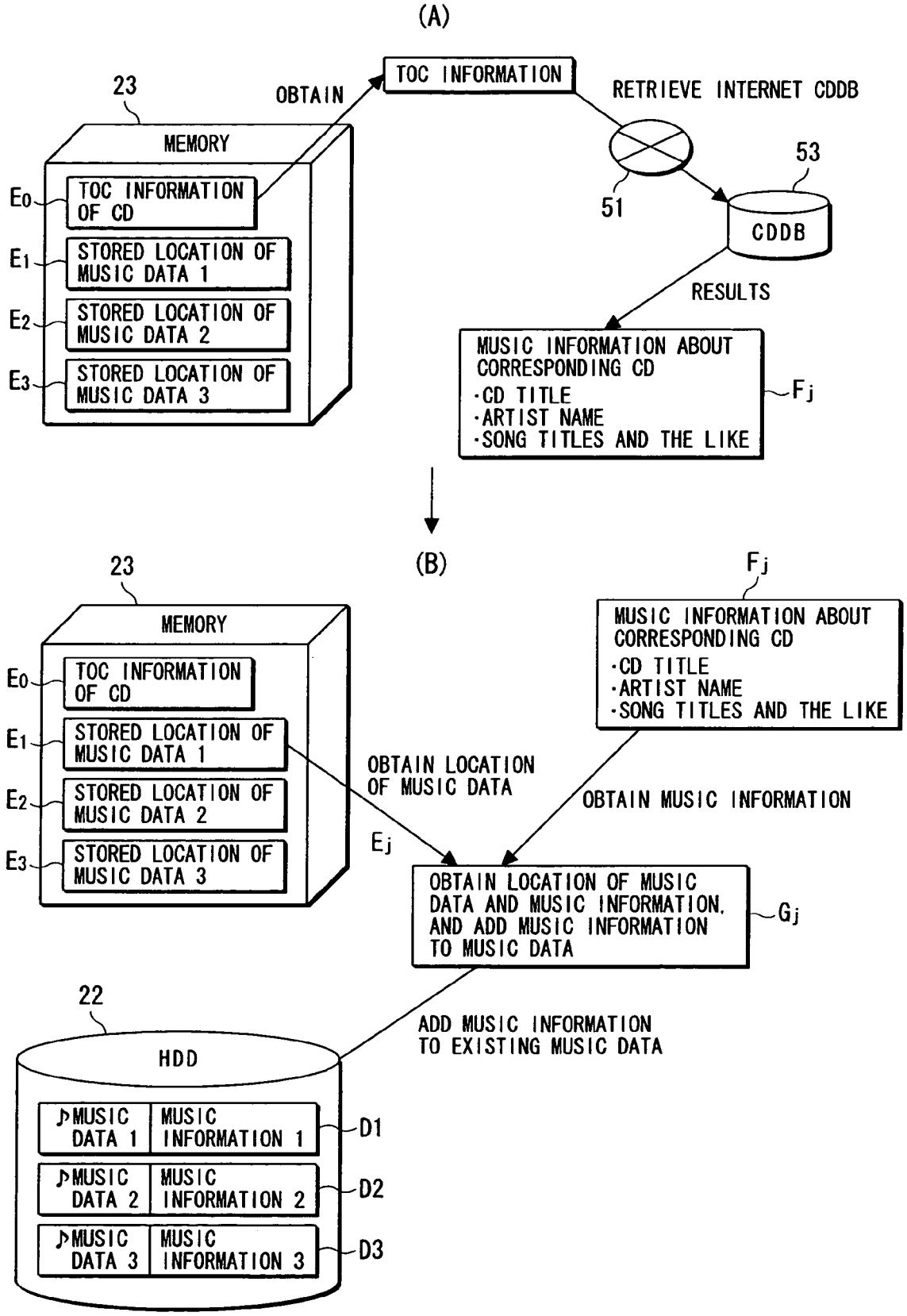
FIG. 7 describes the operation of a second embodiment of the present invention.

Thereafter, the music data management control unit 24 reads a stored location Ej (j=1, 2, 3, . . . ) of a jth song from the memory 23, combines the music information Fj about the jth song and the stored location Ej of the jth song, stores combined data Gi on the hard disk drive 22, and adds the music information Fj to the music data Dj as shown in FIG. 7 (B).

Figure 8:
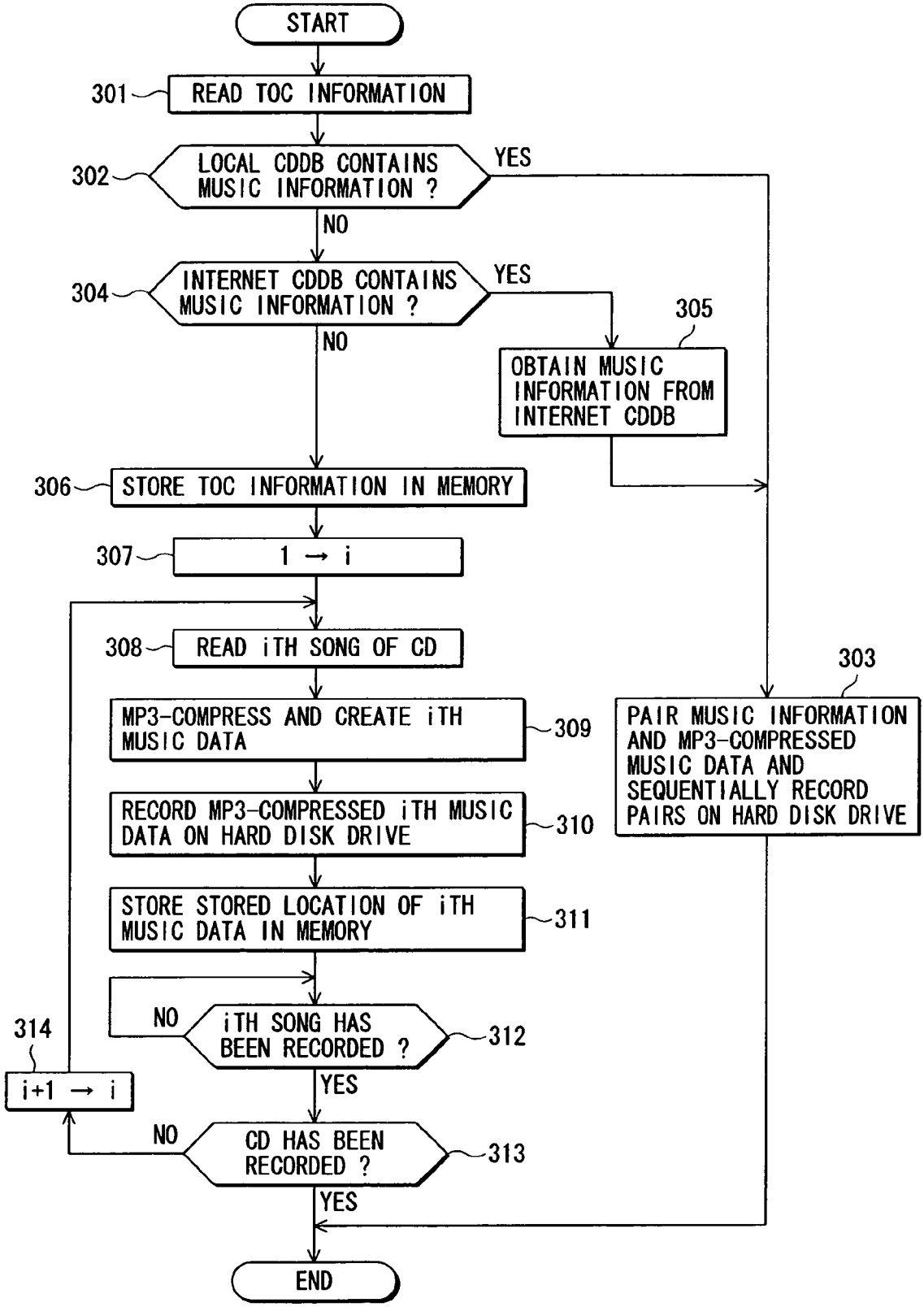
FIG. 8 shows a process flow of the second embodiment for reading music data from a CD, and storing the data on a hard disk drive.

FIG. 8 shows a process flow of the second embodiment for reading music data from a CD, and storing the data on the hard disk drive.

The music data management control unit 24 reads the TOC information from the CD 12 (act 301), checks whether the TOC information is stored in the local CDDB 21 (act 302), reads out music information about the individual songs from the local CDDB 21 if the TOC information is stored in the local CDDB 21, pairs the music information and music data which are encoded (MP3-compressed) individual songs, stores the pairs on the hard disk drive 22 (act 303), and terminates the process.

On the other hand, the TOC information is not stored in the local CDDB 21 in act 302, the music data management control unit 24 transmits the TOC information about the CD to the external apparatus 52, and requests for the music information. The external apparatus 52 transmits the music information about the CD to the music data management control unit 24 if the music information is stored in the Internet CDDB 53. When the music data management control unit 24 receives the music information from the external apparatus 52 (acts 304 to 305), pairs the music information and the music data which are encoded (MP3-compressed) individual songs, stores the pairs on the hard disk drive 22 (act 303), and terminates the process.

However, if the music information about the CD is not stored in the Internet CDDB 53 in the step 304, the music data management control unit 24 stores the TOC information into the memory 23 (act 306). Then, as for i=1 (act 307), the music data management control unit 24 reads an ith song of the CD 12 (act 308), MP3-compresses music data of the ith song into an ith encoded music data (act 309), and records the MP3-compressed ith encoded music data on the hard disk drive 22 (act 310).

Then, the music data management control unit 24 stores a stored location of the encoded music data of the ith song, namely, the stored address (stored location) on the hard disk drive, into the memory 23 (act 311), and monitors if the recording of the ith song has completed (act 312).

When the recording of the ith song completes, the music data management control unit 24 checks whether recording of all the songs on the CD has completed (act 313). If the recording has not completed yet, i is set as i+1→i (act 314), the process starting from act 308 is repeated subsequently, and the recording to the hard disk drive completes when all the songs have been recorded in act 313.

Figure 9:
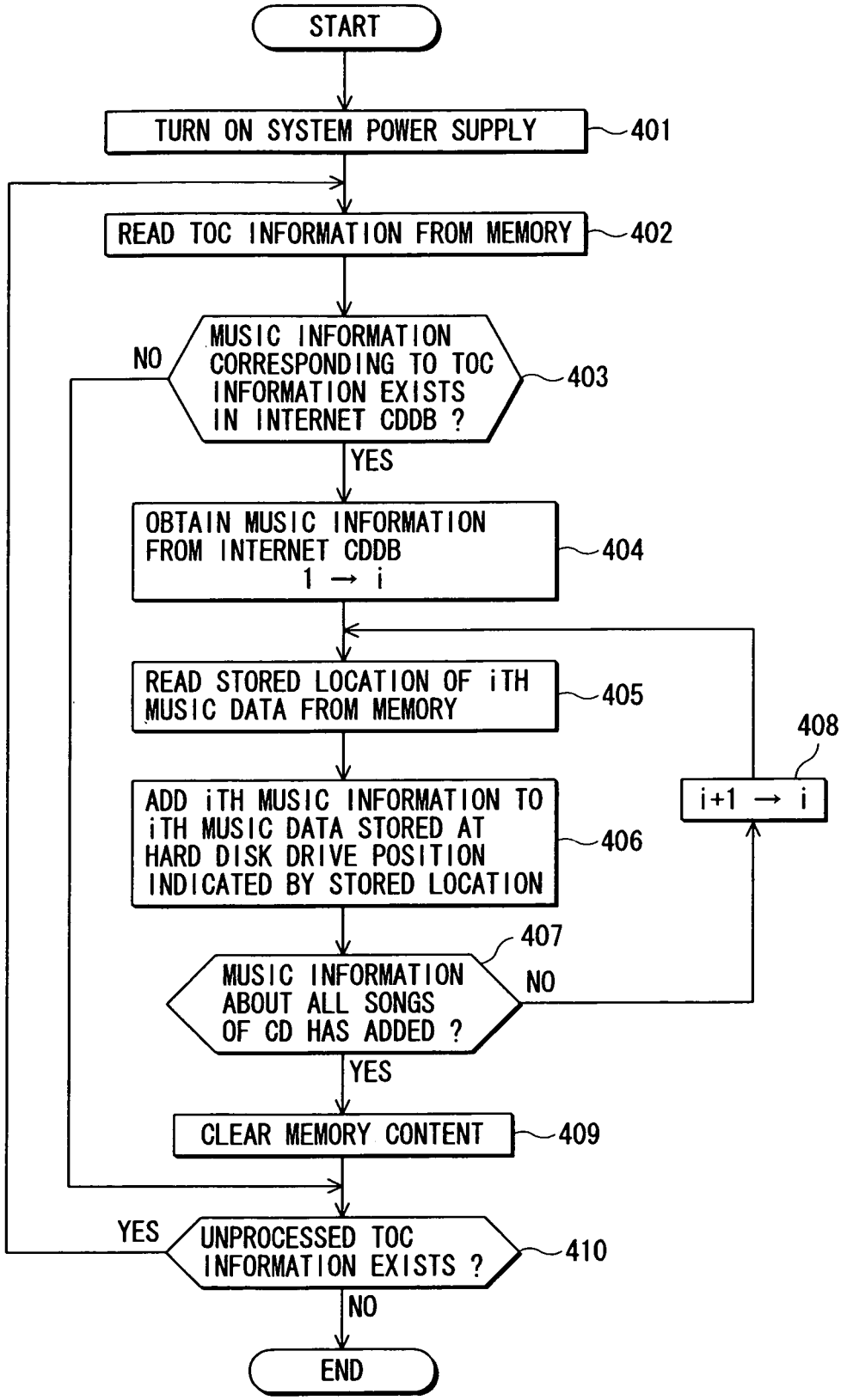
FIG. 9 shows a process flow of the second embodiment which writes correct music information to the hard disk drive when the system starts.

FIG. 9 shows a process flow of the second embodiment, which writes correct music information to the hard disk drive when the system starts.

When an apparatus power supply is turned on, and the systems starts up (act 401), the music data management control unit 24 reads TOC information stored in the memory 23 (act 402), and transmits the TOC information to the external apparatus 52 requesting for music information. When the Internet CDDB 53 does not store the music information about the CD, and thus, the music information is unobtainable (act 403), the music data management control unit 24 checks whether there exists unprocessed TOC information in the memory 23 (act 410), and terminates process if the unprocessed TOC information does not exit, or returns to act 402 and repeats the subsequent process if the unprocessed TOC information exits.

On the other hand, if the music information about the CD corresponding to the TOC information is stored in the Internet CDDB 53, the external apparatus 52 transmits the music information to the music data management control unit 24. When the music data management control unit 24 obtains the music information from the external apparatus 52, it sets i as i=1 (act 404).

Then, the music data management control unit 24 reads a stored location of an ith song from the memory 23 (act 405), adds the ith music information to an ith music data stored at a hard disk drive position indicated by the stored location (act 406). Then, the music data management control unit 24 checks whether addition of music information about all the songs of the CD has completed (act 407), if it has not completed, i is set as i+1→i (act 408), and the music data management control unit 24 repeats the process starting from act 405.

If the addition of the music information about all the song of the CD has completed, the music data management control unit 24 clears stored contents corresponding to the CD in the memory 23 (act 409), then, checks whether unprocessed TOC information exists in the memory 23 (act 410), and terminates the process if the unprocessed TOC information does not exist, or returns to act 402 and repeats the following process if the unprocessed TOC information exists.

Figure 10:
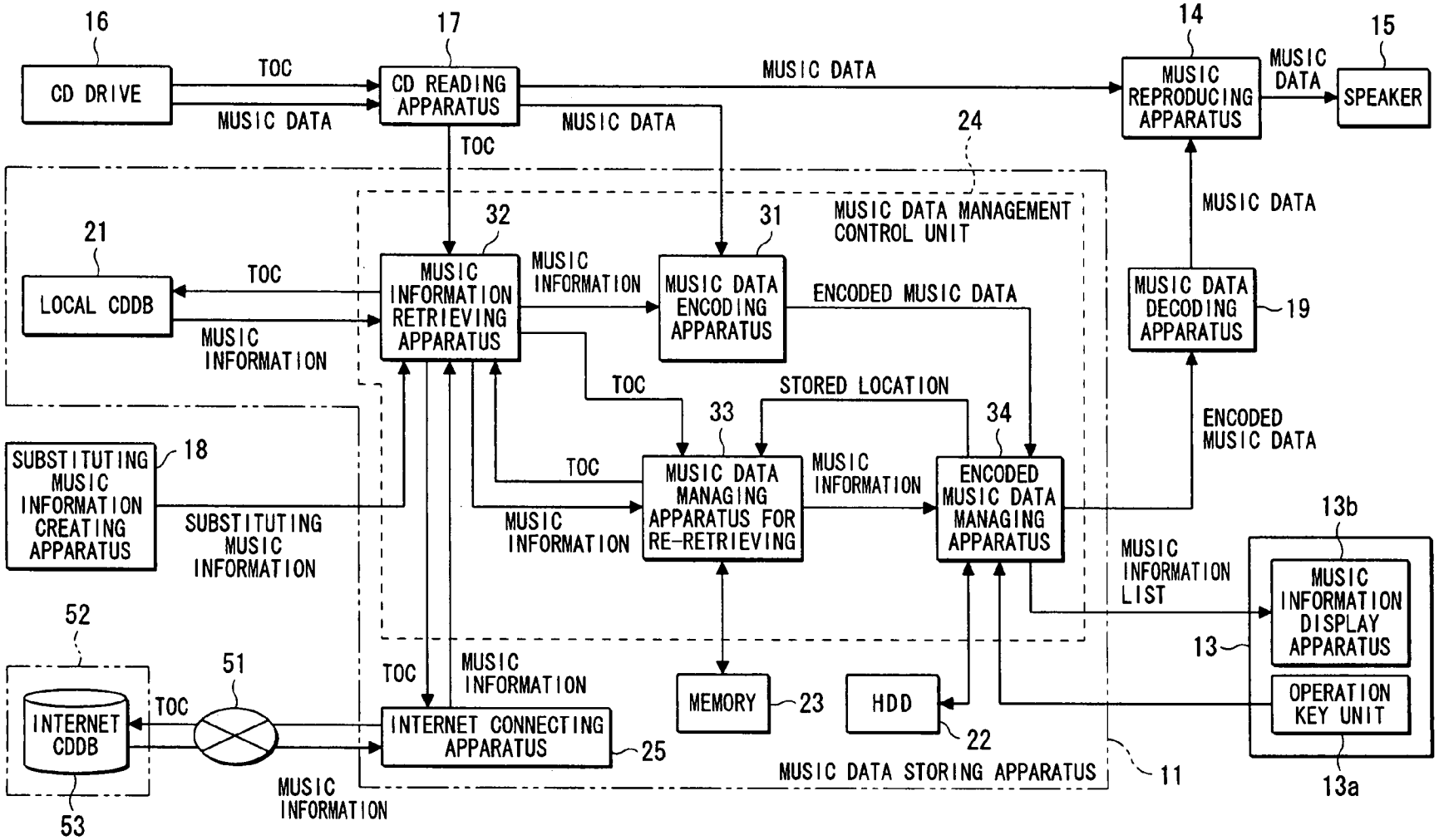
FIG. 10 is a detailed constitution diagram of an audio circuit provided with the music data storing apparatus according to the second embodiment.
Figure 11:
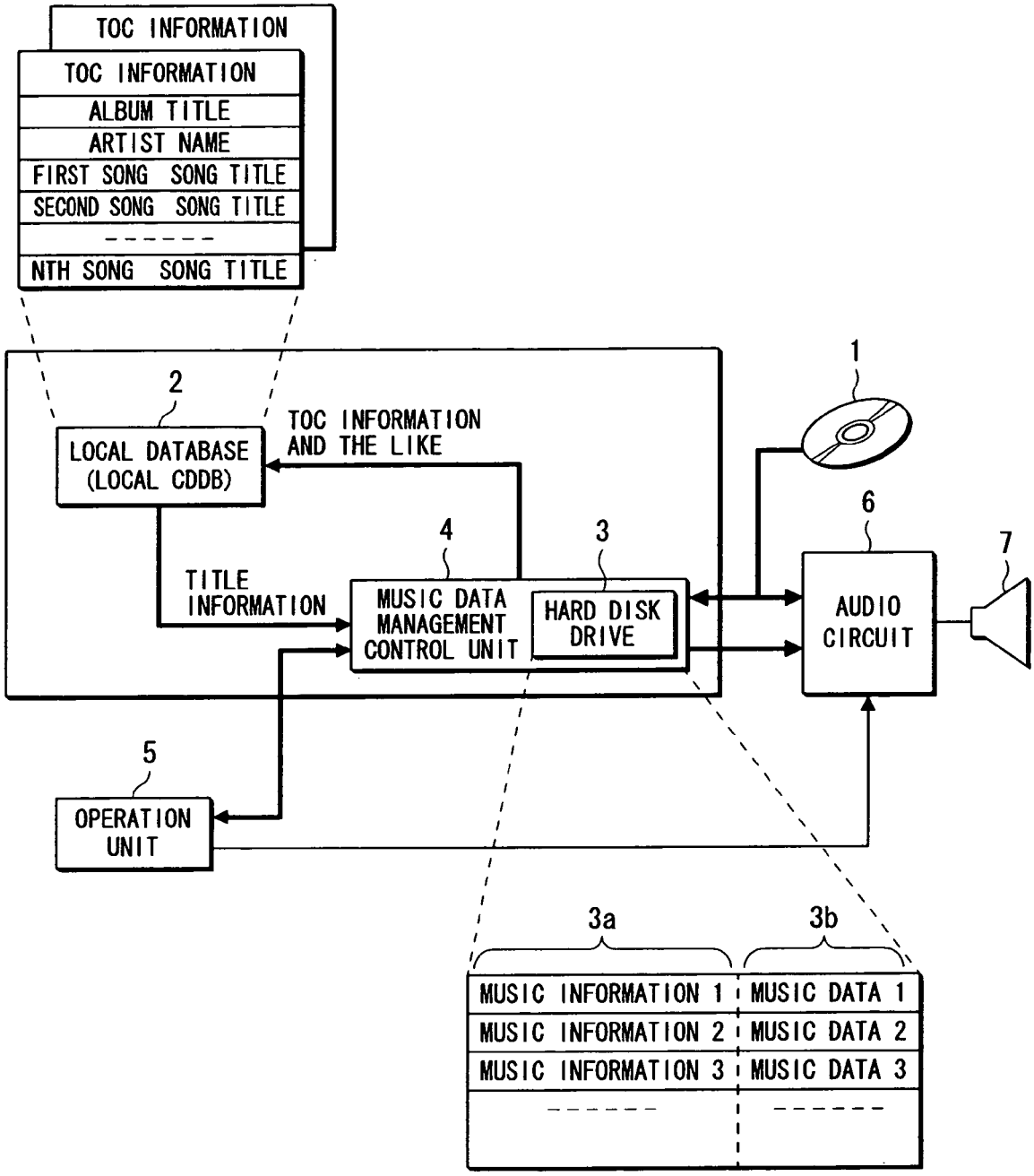
FIG. 11 is a constitution diagram of a music data storing apparatus of the prior art.

FIG. 10 is a detailed constitution diagram of an audio circuit equipped with the music data storing apparatus according to the second embodiment, and the same parts are denoted by the same numerals as in FIG. 5. The different point is that the Internet connecting apparatus 25 is provided in the music data storing apparatus 11, and music information about a CD can be obtained from the Internet CDDB 53 built into the external apparatus 52.

The music data encoding apparatus 31 encodes music data of a song, and (1) adds music information about the song to the encoded music data and inputs them to the encoded music data managing apparatus 34 if the music information is stored in the local CDDB 21. The music data encoding apparatus 31 (2) adds substituting music information created by a user and input from the substituting music information creating apparatus 18 to the encoded music data, and inputs them to the encoded music data managing apparatus 34 if the music information about the song is not stored in the local CDDB 21. The encoded music data managing apparatus 34 stores the music data with the music information on the hard disk drive 22 for the individual songs of the CD in the case (1) described above, and stores the music data with the substituting music information on the hard disk drive 22, and simultaneously inputs stored addresses (stored locations) of the music data of the individual songs to the music data managing apparatus for re-retrieving 33 for the individual songs in the case (2) described above. Note that the substituting music information creating apparatus 18 is not always necessary.

When a CD is recorded, the music data managing apparatus for re-retrieving 33 stores CD identification information (TOC information) about the CD and stored location of the music data of the individual songs on the hard disk drive 22 in the memory 23 if the music information about the CD is not stored in the local CDDB 21, and cannot be obtained from the external apparatus 52. In addition, the music data managing apparatus for re-retrieving 33 inputs TOC information stored in the memory 23 to the music information retrieving apparatus 32 when the system starts. Then, if the music information on a CD identified by the TOC information can be obtained from the external apparatus 52, the music data managing apparatus for re-retrieving 33 obtains music information about a song of the CD through the music information retrieving apparatus 32, and contemporaneously obtains the stored location of the song from the memory 23, pairs the music information and the location, and inputs the pair to the encoded music data managing apparatus 34. The encoded music data managing apparatus 34 rewrites substituting music information added to music data stored at an area indicated by the received stored location with the received music information, and stores them on the hard disk drive. Note that the encoded music data managing apparatus 34 adds the received music information to the music data, and stores them on the hard disk drive if no substituting music information exists.

When a CD is recorded, the music information retrieving apparatus 32 determines whether music information about the CD is stored in the local CDDB 21, and obtains the music information about individual songs of the CD, and inputs the information to the music data encoding apparatus 31 if the music information is stored. On the other hand, the music information about the CD is not stored in the local CDDB 21, the music information retrieving apparatus 32 determines whether the music information about the CD can be obtained from the external apparatus 52, and inputs the information to the music data encoding apparatus 31 if the music information can be obtained. However, if the music information retrieving apparatus 32 cannot obtain the music information neither from the local CDDB 21 nor the external apparatus 52, the music information retrieving apparatus 32 inputs substituting music information to the music data encoding apparatus 31. As a result, the music data encoding apparatus 31 adds the music information or the substituting music information to the encoded music data, and inputs them to the encoded music data managing apparatus 34.

In addition, the music information retrieving apparatus 32 determines whether music information about a CD indicated by TOC information input from the music data managing apparatus for re-retrieving 33 can be obtained from the external apparatus 52 through the Internet on the system startup, and obtains the music information about a song of the CD, and inputs the music information to the music data managing apparatus for re-retrieving 33 if the music information can be obtained. As a result, the music data managing apparatus for re-retrieving 33 pairs the input music information about the song and the stored location of the song read from the memory 23, and inputs the pair to the encoded music data managing apparatus 34. The encoded music data managing apparatus 34 rewrites substituting music information added to music data stored at an area indicated by the received stored location with the received music information, and stores them on the hard disk drive.

To reproduce music information stored on the hard disk drive 22, when reproduction from HDD is requested from the key unit 13*a* of the operation unit 13 to the encoded music data managing apparatus 34, the encoded music data managing apparatus 34 sequentially read out music data from the hard disk drive 22, and inputs the music data to the music data decoding apparatus 19. The music data decoding apparatus 19 decodes the encoded music data, and inputs the decoded data into the music reproducing apparatus 14, thereby outputting sound from the speaker 15. Also, when reproduction at random is requested from the key unit 13*a* of the operation unit 13, since the encoded music data managing apparatus 34 transmits a music information list stored on the hard disk drive 22, and the list is shown on the music information display apparatus 13*b,* desired music can be selected. In addition, when several sets of a sequence of desired songs to be reproduced are determined in advance as folders, it is possible to sequentially reproduce songs in a set by selecting the set.

With the second embodiment, as long as the version of the Internet CDDB of the external apparatus is updated, it is possible to automatically and immediately rewrite the substituting music information recorded in the storing unit such as a hard disk drive with correct music information without updating the version of the local CDDB. In addition, it is possible to rewrite the substituting music information with correct music information even if the music information is not read from a CD again.

While the local CDDB 21 and the memory 23 are provided independent to the hard disk drive 22 in the first and second embodiments, they may be constituted by using a storage area on the hard disk drive 22.

Additionally, in FIGS. 5 and 10, the music information retrieving apparatus 32, the music data managing apparatus for re-retrieving 33, and the encoded music data managing apparatus 34 are constituted as independent hardware elements, they may be a program controlled by using a single microcomputer.

Further, description is given of the case where the music data read from a compact disc CD is stored on the hard disk drive in the first and second embodiments, the present invention can be applied to a case where music data recorded on an arbitrary storage medium other than a CD will be stored, or the present invention can be applied to a case where the music data will be stored in an arbitrary storing apparatus other than a hard disk drive.

In addition, while the TOC information is used as the CD identification information, the CD identification information is not limited to the TOC information, and arbitrary information may be used as the CD identification information.

With the preferred embodiments of the present invention, it is possible to automatically rewrite substituting music information recorded in the storing unit (hard disk drive) with correct music information when the version of the local CDDB is updated.

In addition, with the present invention, as long as the version of the Internet CDDB of the external apparatus is updated, it is possible to automatically and immediately rewrite substituting music information recorded in the storing unit such as a hard disk drive with correct music information without updating the version of the local CDDB.

Further, with the preferred embodiments of the present invention, it is possible to rewrite the substituting music information with correct music information even without reading out the music information from a CD again.

It is to be understood that a wide range of changes and modifications to the embodiments described above will be apparent to those skilled in the art and are contemplated. It is therefore intended that the foregoing detailed description be regarded as illustrative, rather than limiting, and that it be understood that it is the following claims, including all equivalents, that are intended to define the spirit and scope of the invention.

What is claimed is:

1. A music data storing apparatus for adding music information about a song to music data of the song read from a storage medium, comprising:

a first storing unit operable to store music data comprising music information;

a second storing unit operable to store music information about individual songs recorded on a plurality of storage media;

a third storing unit operable to store identification information about songs recorded on a storage medium and store locations of music data of individual songs stored in said first storing unit when music information about songs recorded on the storage medium is not stored in said second storing unit; and a control unit operable to obtain music information about a song from said second storing unit, and if the music information about the song recorded on a storage medium indicated by identification information stored in said third storing unit is stored in said second unit and the version of music information about songs recorded on the storage medium stored at the second storing unit is updated, the control unit is further operable to:

obtain a stored location of the song from said third storing unit, add the obtained music information about a song to the music data stored at the obtained stored location, and store the music data comprising the added music information in said first storing unit.

2. The music data storing apparatus of claim 1, wherein when said control unit stores music data from a storage medium in said first storing unit, said control unit determines whether music information about songs recorded on the storage medium is stored in said second storing unit, obtains the music information, adds the music information to the music data read from the storage medium, and stores the music data comprising the obtained music information in said first storing unit if the music information is stored in said second storing unit.

3. The music data storing apparatus of claim 1, wherein said control unit stores music data of individual songs in the first storing unit without adding music information to the music data or with adding substitute music information to the music data if the music information is not stored in said second storing unit.

4. The music data storing apparatus of claim 1, further comprising:

a music data encoding unit for encoding the music data of the individual songs recorded on said storage medium, wherein said control unit stores encoded music data in said first storing unit.

5. The music data storing apparatus of claim 1, wherein storage areas on a hard disk comprise said first, second and third storing units.

6. The music data storing apparatus of claim 1, wherein said storage medium is a compact disc (CD), and the identification information about said storage medium is TOC information about the CD.

7. The music data storing apparatus of claim 1, wherein said music information includes an album name, an artist name and titles of the individual songs.

8. A music data storing apparatus for adding music information about a song to music data of the song read from a storage medium comprising:

a first storing unit operable to store music data comprising music information;

a second storing unit operable to store music information about individual songs recorded on a plurality of storage media;

a music information obtaining unit operable to obtain music information about individual songs recorded on a storage medium from an external apparatus through the Internet;

a third storing unit operable to store identification information about songs recorded on the storage medium and store locations of music data of individual songs stored in said first storing unit when music information about songs recorded on the storage medium is not stored in said second storing unit and music information about songs recorded on the storage medium is not available from said external apparatus; and a control unit operable to determine whether music information about songs recorded on the storage medium indicated by identification information stored in said third storing unit can be obtained from said external apparatus through the Internet, and if the music information can be obtained from said external apparatus, the control unit is further operable to:

obtain the music information about a song on the storage medium from said external apparatus, obtain a stored location of the song from said third storing unit, add the obtained music information to the music data at the obtained stored location, and store the music data comprising the added music information in said first storing unit.

9. The music data storing apparatus of claim 8, wherein said control unit is operable to store music data stored on a storage medium in said first storing unit, determine whether music information about the songs recorded on the storage medium is stored in said second storing unit, and determine if the music information about the songs recorded on the storage medium can be obtained from said external apparatus through the Internet if the music information about the songs recorded on the storage medium is not stored in said second storing unit, and wherein said control unit is operable to add the music information about a song to the music data of the song read from the storage medium, and store the music data comprising the obtained music information in said first storing unit if the music information about the songs recorded on the storage medium is stored in said second storing unit or can be obtained from said external apparatus through the Internet.

10. The music data storing apparatus of claim 8, wherein said control unit stores music data of individual songs in said first storing unit without adding music information to the music data or with adding substitute music information to the music data if the music information is not stored in said second storing unit.

11. The music data storing apparatus of claim 8, wherein said control unit monitors at system start-up whether music information about a song recorded on a storage medium indicated by identification information stored in said third storing unit can be obtained from said external apparatus through the Internet.

12. The music data storing apparatus of claim 8, further comprising:

a music data encoding unit operable to encode music data of individual songs recorded on said storage medium, wherein said control unit stores encoded music data in said first storing unit.

13. The music data storing apparatus of claim 8, wherein storage areas on a hard disk comprise said first, second and third storing units.

14. The music data storing apparatus of claim 8, wherein said storage medium is a compact disc (CD), and the identification information about said storage medium is TOC information of the CD.

15. The music data storing apparatus of claim 8, wherein said music information includes an album name, an artist name and titles of the individual songs.

16. A music data storing method for adding music information about a song to music data of the song read from a storage medium and then storing the music data comprising the added music information, the method comprising the acts of:

providing first, second and third storing units;

determining whether music information about songs recorded on a storage medium is stored in said second storing unit when storing music data from the storage medium in said first storing unit;

storing the music data of individual songs in said first storing unit without adding music information to the music data or with adding substitute music information to the music data;

storing identification information about songs recorded on said storage medium and stored locations of the music data of the individual songs in said third storing unit when the music information is not stored in said second storing unit;

determining whether music information indicated by identification information stored in said third storing unit is stored in said second storing unit when the version of music information stored in said second storing unit is updated; and storing music information about a song read from said second storing unit in said first storing unit such that the music information is added to music data at a stored location read from said third storing unit if the music information is stored in said second storing unit.

17. The music data storing method of claim 16, wherein when music data from a storage medium is stored in said first storing unit, if music information about the storage medium is stored in said second storing unit, the music information is added to the music data of a song read from said storage medium, and the music data comprising the added music information is stored in said first storing unit.

18. A music data storing method for adding music information about a song to music data of the song read from a storage medium, and then, storing the music data comprising the added music information in a storing unit, the method comprising the acts of:

providing first, second and third storing units;

determining whether music information about songs recorded on a storage medium is stored in said second storing unit, and determining whether music information about individual songs recorded on the storage medium can be obtained from an external apparatus through the Internet if the music information about songs recorded on the storage medium is not stored in said second storing unit when storing the music data from the storage medium in said first storing unit;

storing the music data of individual songs in said first storing unit without adding music information to the music data or with adding substitute music information to the music data;

storing identification information about songs recorded on said storage medium and stored locations of the music data of the individual songs in said third storing unit if the music information about songs recorded on the storage medium is not stored in said second storing unit and cannot be obtained from said external apparatus;

checking whether music information about songs recorded on a storage medium indicated by identification information stored in said third storing unit can be obtained from said external apparatus through the Internet; and storing the music information about a song stored in said first storing unit such that the music information is added to the music data at said stored location read from said third storing unit if the music information can be obtained.

19. The music data storing method of claim 18, wherein when music data from the storage medium is stored in said first storing unit, if music information about songs recorded on the storage medium is stored in said second storing unit or can be obtained from said external apparatus through the Internet, the music information is added to the music data of a song read from the storage medium, and the music data comprising the added music information is stored in said first storing unit.

20. The music data storing method of claim 18, wherein said control unit monitors at system start-up whether it is possible to obtain music information about a storage medium indicated by identification information stored in said third storing unit from said external apparatus through the Internet.

* * * * *